US008848950B2

(12) United States Patent
Shimura

(10) Patent No.: US 8,848,950 B2
(45) Date of Patent: Sep. 30, 2014

(54) CONDENSER MICROPHONE

(75) Inventor: Haruhito Shimura, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 431 days.

(21) Appl. No.: 13/289,462

(22) Filed: Nov. 4, 2011

(65) Prior Publication Data

US 2012/0114146 A1 May 10, 2012

(30) Foreign Application Priority Data

Nov. 8, 2010 (JP) ..... 2010-249384

(51) Int. Cl.
*H04R 25/00* (2006.01)
*H04R 19/01* (2006.01)
*H04R 9/08* (2006.01)

(52) U.S. Cl.
CPC ..... *H04R 19/016* (2013.01)
USPC ..... 381/174; 381/355; 381/369

(58) Field of Classification Search
CPC ..... H04R 1/04; H04R 1/08; H04R 1/086; H04R 1/342; H04R 1/38; H04R 1/406; H04R 19/04; H04R 19/06; H04R 9/08
USPC ..... 381/174, 355, 369
See application file for complete search history.

(56) References Cited

U.S. PATENT DOCUMENTS 6,151,399 A * 11/2000 Killion et al. ..... 381/313
8,280,078 B2 * 10/2012 Yoshino ..... 381/174

FOREIGN PATENT DOCUMENTS

| | | |
|---|---|---|
| JP | 11-117172 | 4/1999 |
| JP | 2005-136628 A | 5/2005 |
| JP | 2006-295357 A | 10/2006 |
| JP | 2008-118260 A | 5/2008 |
| JP | 2008-131160 | 6/2008 |

* cited by examiner

*Primary Examiner* — Brian Ensey
(74) *Attorney, Agent, or Firm* — Whitham Curtis Christofferson & Cook, PC

(57) ABSTRACT

A condenser microphone includes a plurality of condenser microphone units, each unit including a diaphragm and a fixed electrode one of which has an electret layer thereon. The condenser microphone units include respective sensitivity controllers changing sensitivities of the units. The sensitivity controllers include respective variable resistors connected between a power source and a ground. Each of the variable resistors has a slidable terminal connected to one, opposed to the electret layer, of the diaphragm and the fixed electrode, of the corresponding condenser microphone unit.

7 Claims, 4 Drawing Sheets

CONDENSER MICROPHONE

BACKGROUND OF THE INVENTION

1. Field of the Invention

The present invention relates to a condenser microphone of which the sensitivity can be adjusted, and particularly relates to a condenser microphone that include a plurality of condenser microphone units between which variations in sensitivity can be controlled.

2. Related Background Art

An electret condenser microphone unit includes an electret material, composed of a material such as fluoroethylene polymer (FEP), on at least one of a diaphragm and a fixed electrode opposed to the diaphragm. In a known method of forming a material into an electret, corona discharge is used, for example, as disclosed in Japanese Unexamined Patent Application Publication No. 11-117172. A corotron or scorotron is typically used for generating corona discharge. A non-uniform electric field is formed in such a device so that corona discharge is generated therein. This generates negative ions to which the material is then exposed and formed into an electret. The electret material formed in such a way generally has a variable surface potential depending on the discharge condition. Such a variation in surface potential causes about 10% of variation in sensitivity in an electret condenser microphone unit including the electret material.

Some condenser microphones such as stereo condenser microphones and variable directional condenser microphones each include a plurality of condenser microphone units. Since variations in sensitivity between the condenser microphone units have a disadvantageous effect on the microphone, the sensitivity of each unit must be set constant. For example, in the case where the above-described electret condenser microphone units are included in such a condenser microphone, the condenser microphone units must have small variations in sensitivity therebetween or the sensitivities of the individual condenser microphone units must be adjusted. Much time and cost, however, are required for picking up units having small variations in sensitivity from a large number of condenser microphone units. In addition, no simple method has been proposed to control the sensitivities of individual condenser microphone units.

The sensitivity of the condenser microphone unit may vary with any factor other than a variation in surface potential of an electret layer. For example, the sensitivity of the condenser microphone unit may vary due to a structural relationship between components included in the unit. It is therefore desirable that the sensitivity be adjusted after the components are assembled into a condenser microphone unit.

Japanese Unexamined Patent Application Publication No. 2008-131160 discloses a condenser microphone that includes a needle-shaped electrode having a tip near the back of a fixed electrode of an electret condenser microphone unit, in which a voltage is applied to the needle-shaped electrode to generate ions so as to neutralize an electret and thus to adjust the sensitivity of the microphone unit. The sensitivity of this condenser microphone unit can be adjusted using the ions that neutralize the electret even after the microphone is assembled.

Unfortunately, in the case where a plurality of condenser microphone units are included in such a condenser microphone, each condenser microphone unit needs to have a needle-shaped electrode in order to adjust the sensitivity of the microphone unit, leading to a complicated configuration of the unit. Moreover, a plurality of needle-shaped electrodes must be provided, leading to an increase in manufacturing cost of the condenser microphone. Furthermore, JP-A-2008-131160 does not refer to the control of the sensitivities of two or more condenser microphone units.

SUMMARY OF THE INVENTION

In view of the circumstances above, an object of the present invention is to provide a condenser microphone including a plurality of condenser microphone unit of which sensitivities can be readily adjusted in a simple configuration even if these condenser microphone units have large variations in sensitivity therebetween.

A condenser microphone according to an embodiment of the invention includes a plurality of electret condenser microphone units each including a diaphragm and a fixed electrode opposed to the diaphragm, one of the diaphragm and the fixed electrode having an electret layer thereon, wherein the condenser microphone units include respective sensitivity controllers changing sensitivities of the units, the sensitivity controllers include respective variable resistors connected between a power source and ground, and each of the variable resistors has a slidable terminal connected to one, opposed to the electret layer, of the diaphragm and the fixed electrode of the corresponding condenser microphone unit.

According to the condenser microphone of an embodiment of the invention, the microphone includes a plurality of condenser microphone units, and can vary the voltage of a part, opposed to an electret layer, of each unit and thus vary the polarization voltage, achieving ready adjustment of the sensitivities of the condenser microphone units.

DESCRIPTION OF THE PREFERRED EMBODIMENTS

A condenser microphone according to an embodiment of the present invention is described below with reference to the attached drawings.

First Embodiment

Figure 1:
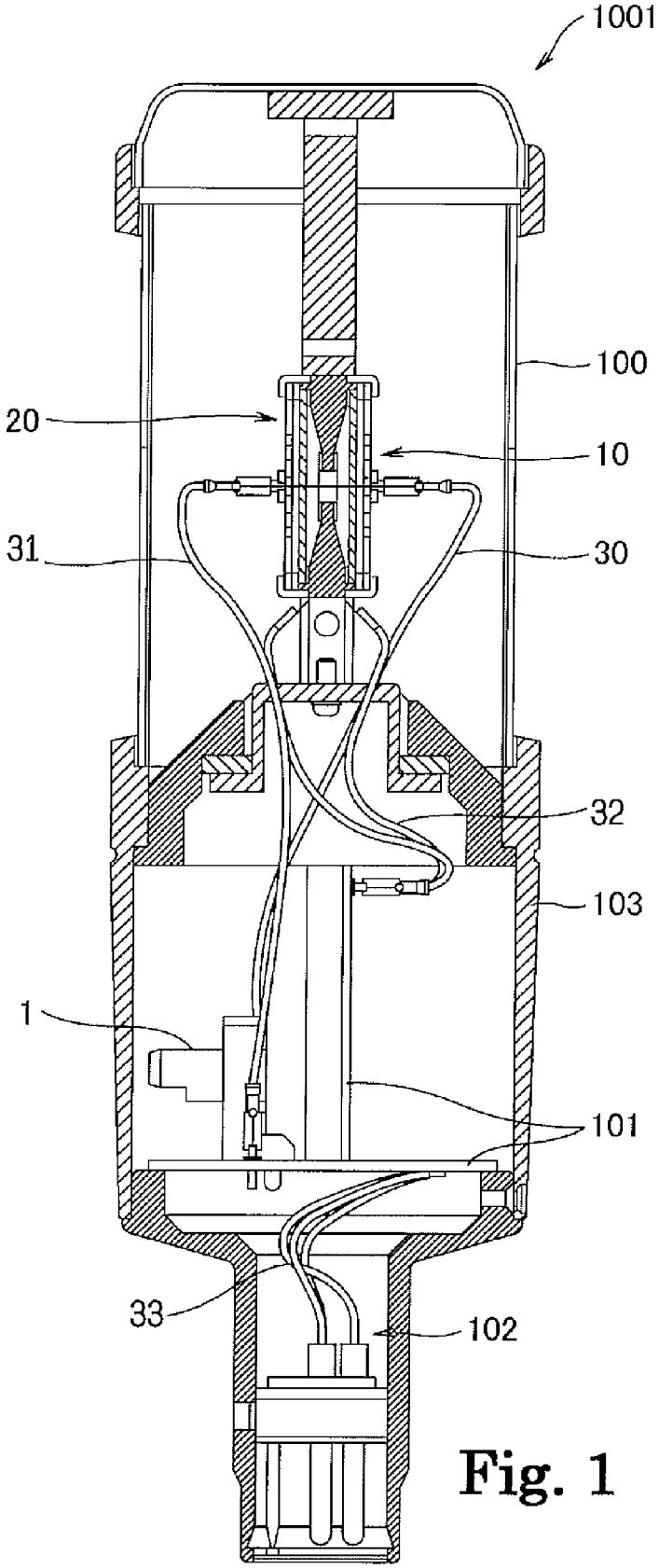
FIG. 1 is a section view of a condenser microphone according to an embodiment of the invention.

FIG. 1 shows a condenser microphone 1001 that includes condenser microphone units 10 and 20 each having a bottomed cylindrical shape; a sensitivity controller 1 and a circuit board 101 within a cylindrical housing 103; and a connector 102 that is protected by a cylindrical peripheral wall. In FIG. 1, the connector 102, the circuit board 101 and the sensitivity controller 1, and the condenser microphone units 10 and 20 are disposed in this order from the bottom. The condenser microphone units 10 and 20 are enclosed by a cylindrical microphone cover 100 having a net pattern for picking up a sound. A fixed member may be provided for reinforcement of the rigidity on a top (the upper side in FIG. 1) of the microphone cover 100, as shown in FIG. 1. The sensitivity controller 1 is electrically connected through wiring lines 30 to 33 to respective diaphragms 11 and 21 within the condenser microphone units 10 and 20. The sensitivity controller 1 may be disposed at any other position on the basis of an appropriate design concept. In addition, each of the microphone cover 100, the housing 103, and the connector 102 may have any other shape on the basis of an appropriate design concept.

Figure 2:
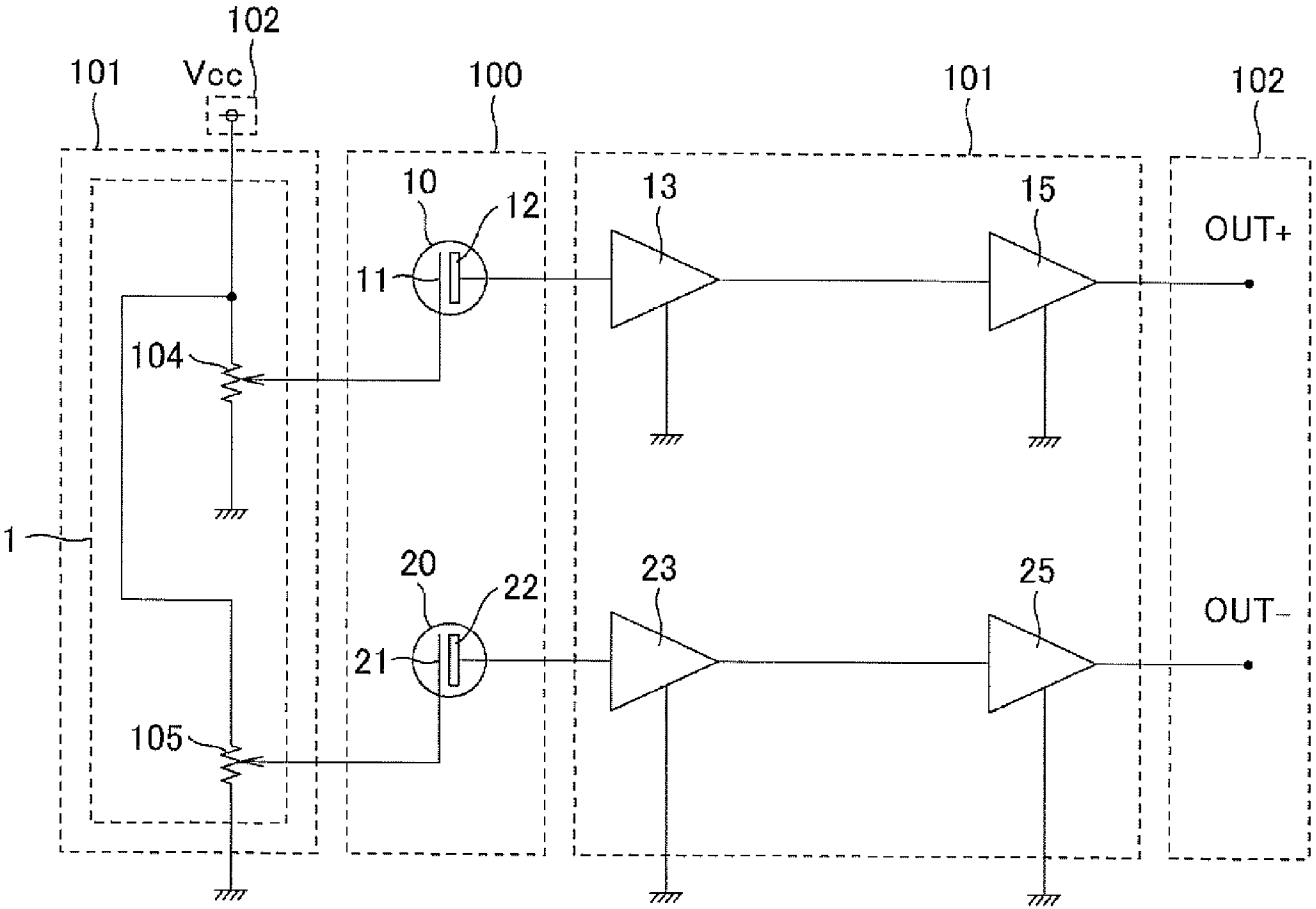
FIG. 2 is a circuit diagram of an exemplary circuit applicable to an condenser microphone according to an embodiment of the invention.

The circuit board 101 within the housing 103 is provided with, for example, a power source circuit, and impedance converters 13 and 23 each including FET or a vacuum tube, and buffer amplifiers 15 and 25, as shown in FIG. 2. The connector 102 is disposed below the circuit board 101 to lead sound signals from the condenser microphone units 10 and 20 to the outside, and to apply a voltage to the microphone units 10 and 20. The wiring lines 30 electrically connect the condenser microphone units 10 and 20, the sensitivity controller 1, lines on the circuit board 101, and the connector 102, as described later.

FIG. 1 illustrates a variable directional microphone including the condenser microphone units 10 and 20 arranged back-to-back. Alternatively, the units 10 and 20 may be horizontally arranged parallel or at an appropriate opening angle so as to form a stereo microphone. The condenser microphone 1001 may have any other configuration on the basis of an appropriate design concept. For example, each component is preferably partitioned by a shield member so as to be shielded from external electromagnetic waves. In addition, the connector 102 is preferably surrounded by a cover as shown in FIG. 1.

Next, an exemplary circuit incorporated in the microphone of the invention is described with reference to FIG. 2. The condenser microphone unit 10 includes a diaphragm 11 and a fixed electrode 12, which are opposed to each other and configure a capacitor. The diaphragm 11 oscillates upon receiving acoustic waves, so that the capacity of the capacitor varies, leading to electroacoustic conversion between the diaphragm 11 and the fixed electrode 12, and thus a sound signal is output. The sound signal is output to the outside from the connector 102 in FIG. 1 through the impedance converter 13 including the FET and the buffer amplifier 15. Similarly, the condenser microphone unit 20 includes a diaphragm 21 and a fixed electrode 22, which are opposed to each other and configure a capacitor. The diaphragm 21 oscillates upon receiving acoustic waves, so that the capacity of the capacitor varies, leading to electroacoustic conversion between the diaphragm 21 and the fixed electrode 22, and thus a sound signal is output. The sound signal is output to the outside from the connector 102 through the impedance converter 23 and the buffer amplifier 25.

A signal output from the buffer amplifier 15 for the condenser microphone unit 10 corresponds to a signal from a HOT side of balanced output, and a signal output from the buffer amplifier 25 for the condenser microphone unit 20 corresponds to a signal from a COLD side thereof. The connector 102 is a so-called XLR 3-pin connector with a first pin as a ground terminal, a second pin as a HOT signal terminal, and a third pin as a COLD signal terminal. In the case of a stereo microphone, for example, respective signals of two channels are divided into balanced signals, and the balanced signals are output through a so-called XLR 5-pin connector with a first pin as ground, a second pin as L (left)-HOT, a third pin as L (left)-COLD, a fourth pin as R (right)-HOT, and a fifth pin as R (right)-COLD.

The sensitivity controller 1 changes the sensitivity of each of the condenser microphone units 10 and 20. The sensitivity controller 1 includes variable resistors 104 and 105 between a power source Vcc and ground. The variable resistors 104 and 105 are connected in parallel between the power source Vcc and ground, and respective slidable terminals of the resistors 104 and 105 are connected to the diaphragms 11 and 21 of the condenser microphone units 10 and 20. Each of the variable resistors 104 and 105 divides a voltage of the power source Vcc depending on the position of each slidable terminal, and such a divided voltage is applied to each of the diaphragms 11 and 21. The voltage from the power source Vcc is supplied to the variable resistors through the power source circuit on the circuit board 101, the power source being in common with that of the impedance converters 13 and 23 and the buffer amplifiers 15 and 25. Specifically, the power source Vcc applies a voltage to the variable resistors 104 and 105, which is the sensitivity controller 1, through the connector 102 and the power source circuit on the circuit board 101. While two variable resistors are provided as the sensitivity controller 1 in the embodiment, only one variable resistor is shown in FIG. 1.

In the embodiment, the condenser microphone unit 10 has an electret layer on the fixed electrode 12. Similarly, the condenser microphone unit 20 has an electret layer on the fixed electrode 22. The respective slidable terminals of the variable resistors 104 and 105 are connected to the diaphragms 11 and 21 opposed to the electret layers. Accordingly, when the slidable terminals move in the same direction, voltages are applied in the same direction to the diaphragms 11 and 21.

If a difference in sensitivity is observed between the condenser microphone units 10 and 20 in the circuit shown in FIG. 2, the difference can be eliminated by adjusting at least one of the variable resistors 104 and 105. For example, if the condenser microphone unit 10 has a higher sensitivity than the condenser microphone unit 20, the variable resistor 104 is adjusted such that the polarization voltage of the condenser microphone unit 10 decreases, or the variable resistor 105 is adjusted such that a polarization voltage of the condenser microphone unit 20 increases.

An example of the sensitivity control of the condenser microphone units 10 and 20 is now explained with specific voltage values. Supposing that each of the condenser microphone units 10 and 20 has a target surface potential, −100V, of the electret layer and the voltage of the power source Vcc is 30V, the electric potential of each of parts of the condenser microphone units 10 and 20, the parts being opposed to the electric layers, or the diaphragms 11 and 21 in the embodiment, is varied within the range of 0 to 30 V for the sensitivity control. Accordingly, the polarization voltage can be controlled within a range of ±15%.

The polarization voltage of each of the condenser microphone units 10 and 20 is thus adjusted to control the sensitivity of each condenser microphone unit. This enables the sensitivity to be adjusted to be constant after assembling a microphone even if the sensitivity varies between the units. The sensitivity of each of the condenser microphone units 10 and 20 can be thus adjusted only by adjusting the variable resistors 104 and 105, enabling the sensitivity to be readily adjusted in a simple configuration. This is particularly effective for a stereo microphone or a variable directional microphone including a plurality of condenser microphone units where variations in sensitivity between the units must be reduced to the utmost.

The condenser microphone according to the invention is designed on the assumption that the sensitivity of the condenser microphone unit is adjusted mainly in a manufacturing process of the microphone. For example, the condenser microphone 1001 is assembled as shown in FIG. 1, and then the sensitivity of each of the condenser microphone units 10 and 20 is measured by a measuring instrument and concurrently adjusted by the sensitivity controller 1. After that, the housing 103 is fixed to the assembly so that the condenser microphone 1001 is completed. Alternatively, a hole is preliminarily formed in the housing 103, and the sensitivity of each of the condenser microphone units 10 and 20 is adjusted by manipulating the sensitivity controller 1 through the hole with a jig, and then the hole is covered so that the condenser microphone 1001 is completed. In this way, the sensitivity of the condenser microphone units according to the invention can be smoothly adjusted, and thus condenser microphone products including the condenser microphone units can be smoothly shipped.

The condenser microphone units 10, 20 may be of any other electret type where an electret layer is formed on each of the fixed electrodes 12 and 22, or may be of any other type of condenser microphone unit. In particular, the configuration of the condenser microphone according to the invention is preferably applied to the electret condenser microphones, which tend to have variable sensitivity as described above. Any number of condenser microphone units can be incorporated in one condenser microphone 1001.

Second Embodiment

Figure 3:
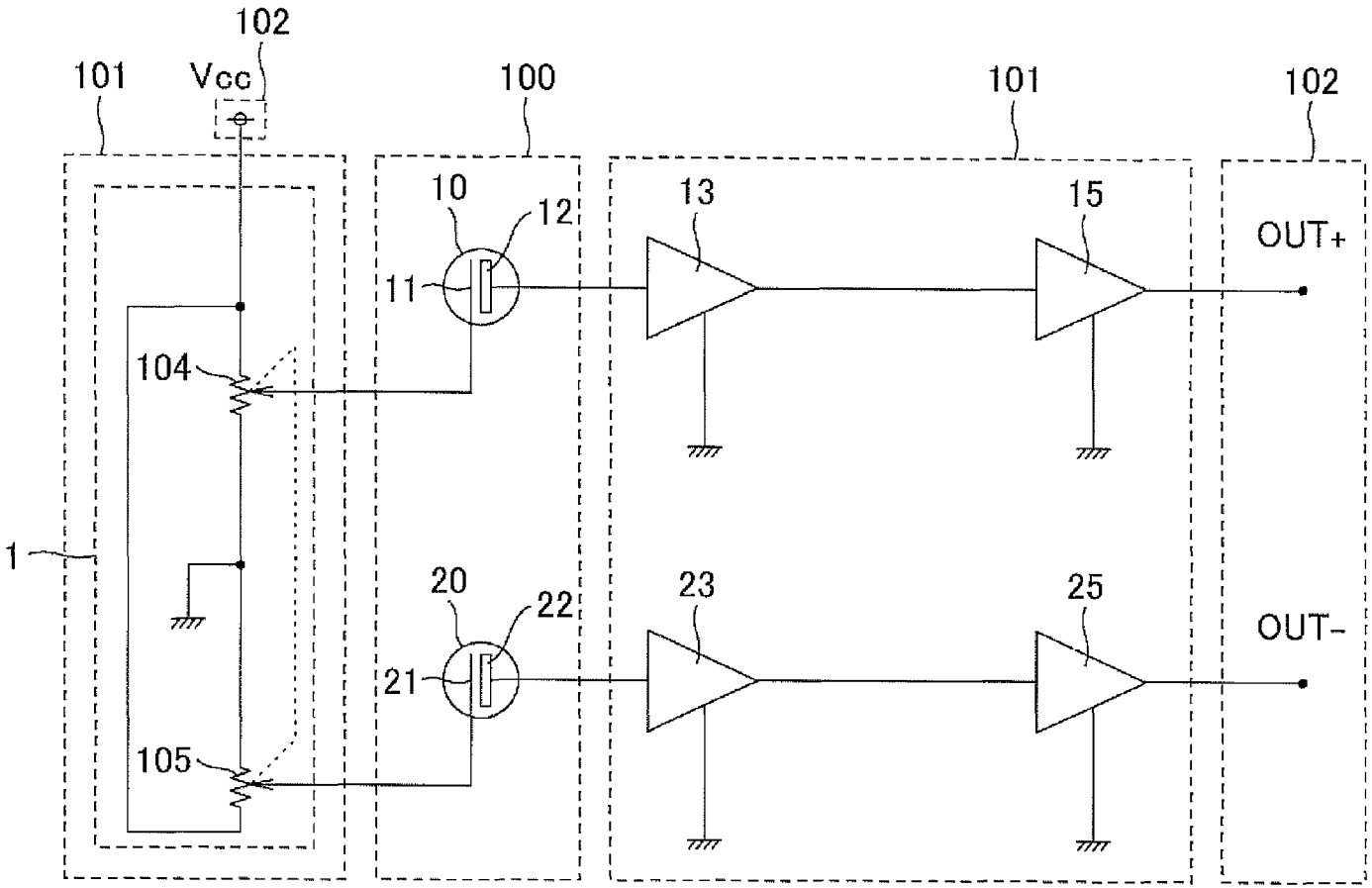
FIG. 3 is a circuit diagram of another exemplary circuit applicable to a condenser microphone according to an embodiment of the invention.

A second embodiment is now described with reference to FIG. 3. In the second embodiment, condenser microphone units are provided with a double variable resistor. In FIG. 3, variable resistors 104 and 105 are connected in parallel in mutually opposite directions between the power source Vcc and ground. Other circuit configurations are the same as that in the embodiment shown in FIG. 2 and omitted from the description.

In the embodiment shown in FIG. 3, upon operation of a common axis of the double variable resistor 104 and 105 configuring the double variable resistor, a voltage applied to a diaphragm of a first microphone unit increases while a voltage applied to a diaphragm of a second microphone unit decreases. This increases a polarization voltage of the first microphone unit, resulting in an increase in sensitivity of the first unit, and decreases a polarization voltage of the second microphone unit, resulting in a decrease in sensitivity of the second unit. The operation of the control axis of the double variable resistor equalizes the sensitivities of the microphone units each other at a point within the operable range. In this way, according to the condenser microphone of the embodiment, the sensitivities of the condenser microphone units can be adjusted through a single operation so as to eliminate variations in sensitivity between the units.

Third Embodiment

Figure 4:
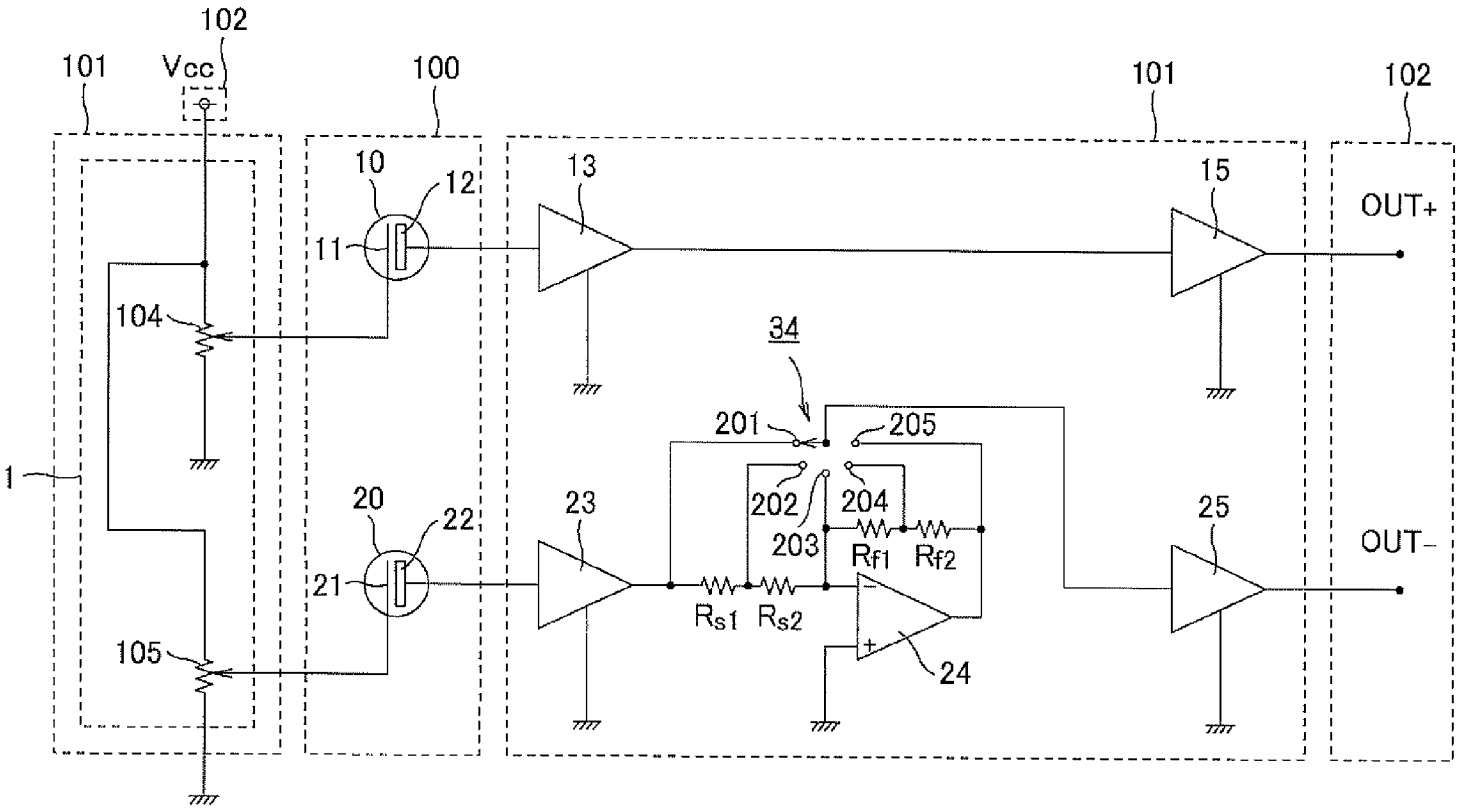
FIG. 4 is a circuit diagram of still another exemplary circuit applicable to a condenser microphone according to an embodiment of the invention.

A third embodiment is now described with reference to FIG. 4. In the embodiment, a sensitivity controller 1 characteristic of the present invention is incorporated in a variable directional condenser microphone. The sensitivity controller 1 includes variable resistors 104 and 105 in correspondence to condenser microphone units 10 and 20 in the same way as the previous sensitivity controller 1 shown in FIG. 2. The microphone unit 10 functions as a front element, and the microphone unit functions as a back element for which the following directionality-switching circuit including an inverting amplifier 24 is provided between an impedance converter 23 and a buffer amplifier 25.

An inverting input terminal of the inverting amplifier 24 receives a signal output from the impedance converter 23 through an input resistance. The input resistance includes two input resistance elements Rs1 and Rs2 connected in series. A non-inverting input terminal of the inverting amplifier 24 is grounded. A feedback resistance is connected between an output terminal and the inverting input terminal of the inverting amplifier 24. The feedback resistance includes two feedback resistance elements Rf1 and Rf2 connected in series. The gain of the inverting amplifier 24 is determined by a ratio of the feedback resistance to the input resistance. The input resistance is divided into the resistance elements Rs1 and Rs2 and the feedback resistance is divided into the resistance elements Rf1 and Rf2 as described above, and a switch 34 switches the connecting points of the divided resistances so that output from one side of the balanced output is switched, achieving the variable directionality of a balanced output signal. While all the resistance elements Rs1, Rs2, Rf1, and Rf2 have an identical resistance value in the above description, the resistance elements may have different values depending on the design concept.

The switch 34 has five switching contacts (fixed contacts) and one movable contact connected to an input terminal of the buffer amplifier 25. A first switching contact 201 of the switch 34 is connected to an output terminal of the impedance converter 23. A second switching contact 202 is connected to a connecting point of the input resistance elements Rs1 and Rs2. A third switching contact 203 is connected to the inverting input terminal of the inverting amplifier 24. A fourth contact 204 is connected to a connecting point of the feedback resistance elements Rf1 and Rf2. A fifth switching contact 205 is connected to the output terminal of the inverting amplifier 24.

In this way, the condenser microphone of the embodiment has an output signal system on one side of the balanced output, and the system has the inverting amplifier 24 of which the respective input and feedback resistances are divided and has the switch that selects any one of the connecting points of the divided input and feedback resistances of the inverting amplifier 24 to switch a signal output point. Such a configuration can vary the directionality of a balanced output signal.

In the variable directional condenser microphone according to the embodiment, the switch need not always select one of the connecting points of all the divided input and feedback resistances of the inverting amplifier 24, and the switch may select one of the connecting points of resistances while only the input resistance is divided. Alternatively, the switch may select one of the connecting points of resistances while only the feedback resistance is divided.

In the case where the switch selects one of the connecting points of the resistances while only the input or feedback resistance is divided, the switching range of directionality is narrow. To achieve a wide switching range of directionality, the switch desirably selects one of the connecting points of the resistances while both the input and feedback resistances are divided as described above.

Alternatively, the switch may include a variable resistor with a central tap, where one side of the variable resistor from the central tap is used as the input resistance of the inverting amplifier, and the other side is used as the feedback resistance of the inverting amplifier, so that a signal from one side of the balanced output is output through a slider of the variable resistor. This also achieves the variable directionality of a balanced output signal.

The technical concept of the condenser microphone according to the invention can be applied not only to the electret condenser microphone but also to a DC bias condenser microphone, for example.

What is claimed is:

1. A condenser microphone comprising:

a plurality of electret condenser microphone units, each including a diaphragm and a fixed electrode opposing the diaphragm, one of the diaphragm and the fixed electrode having an electret layer thereon, one or more sensitivity controllers changing sensitivities of one or more units of the plurality of electret condenser microphone units, wherein the one or more sensitivity controllers include one or more variable resistors connected between a power source and a ground, there being for each unit of said plurality of electret condenser microphone units a respective variable resistor, wherein each of the one or more variable resistors has a slidable terminal connected to one of the diaphragm and the fixed electrode of the a corresponding condenser microphone unit such that the slidable terminal is opposing the electret layer of the corresponding condenser microphone unit, and wherein at least two variable resistors of said plurality of electret condenser microphone units are configured together as a double variable resistor and are connected to the power source in mutually opposite directions with respect to the ground.

2. The condenser microphone according to claim 1, wherein the fixed electrode of each of the plurality of electret condenser microphone units has the electret layer thereon, and the slidable terminal of the respective variable resistor is connected to the diaphragm of the corresponding condenser microphone unit.

3. The condenser microphone according to claim 1, wherein the diaphragm of each of the plurality of electret condenser microphone units has the electret layer thereon, and the slidable terminal of the respective variable resistor is connected to the fixed electrode of the corresponding condenser microphone unit.

4. The condenser microphone according to claim 1, wherein the condenser microphone units of the plurality of electret condenser microphone units are arranged so as to correspond to two channels of a stereo microphone.

5. The condenser microphone according to claim 1, wherein the condenser microphone units of the plurality of electret condenser microphone units are arranged back-to-back and connected to produce a balanced output, and a switch is provided to vary the balanced output to produce a variable directional balanced output.

6. The condenser microphone according to claim 1, wherein the plurality of electret condenser microphone units is two condenser microphone units with two corresponding variable resistors, and the two variable resistors being configured as the double variable resistor.

7. The condenser microphone according to claim 2, wherein a decrease in a resistance of a first variable resistor of the double variable resistor increases a voltage applied to a diaphragm connected to the first variable resistor and decreases a voltage applied to a diaphragm connected to a second variable resistor of the double variable resistor.

* * * * *